US008979405B2

(12) United States Patent
Zhang et al.

(10) Patent No.: US 8,979,405 B2
(45) Date of Patent: Mar. 17, 2015

(54) PRINT PREVIEW FOR PRINTERS WITH MULTIPLE PRINT HEADS

(75) Inventors: Yichun Zhang, Webster, NY (US); Patrick Rolling, Southington, CT (US); Paul R. Sette, Branford, CT (US); Richard A. Sloan, Jr., Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 2924 days.

(21) Appl. No.: 11/136,142

(22) Filed: May 24, 2005

(65) Prior Publication Data

US 2006/0269344 A1 Nov. 30, 2006

(51) Int. Cl.
*B41J 3/46* (2006.01)
*B41J 3/54* (2006.01)
*G07B 17/00* (2006.01)

(52) U.S. Cl.
CPC .... *B41J 3/54* (2013.01); *B41J 3/46* (2013.01); *G07B 2017/00298* (2013.01); *G07B 2017/00524* (2013.01)
USPC ..... 400/84; 400/70; 400/83

(58) Field of Classification Search
USPC ..... 400/70, 71, 83, 84
See application file for complete search history.

(56) References Cited

U.S. PATENT DOCUMENTS

| | | | | |
|---|---|---|---|---|
| 4,311,399 | A * | 1/1982 | Wegryn et al. | 400/76 |
| 5,156,478 | A * | 10/1992 | Jobs | 400/705 |
| 5,172,988 | A * | 12/1992 | Ledley et al. | 400/83 |
| 5,539,863 | A * | 7/1996 | Ueda et al. | 358/1.2 |
| 6,722,801 | B2 * | 4/2004 | Snape | 400/76 |
| 2003/0184605 | A1 * | 10/2003 | Manduley | 347/2 |
| 2004/0085568 | A1 * | 5/2004 | Sesek et al. | 358/1.15 |

FOREIGN PATENT DOCUMENTS

JP 02173864 A * 7/1990

* cited by examiner

*Primary Examiner* — Jill Culler
(74) *Attorney, Agent, or Firm* — Steven J. Shapiro; Charles R. Malandra, Jr.

(57) ABSTRACT

A printing system has fixed print heads in positions that are subject to adjustment between print jobs. The system provides a print preview display that includes a representation of the item of printing stock on which the printing is to be performed. The print preview display also includes a first printing field that is at a location in the representation that corresponds to the position of a first one of the print heads. The print preview display further includes a second printing field that is at a location in the representation that corresponds to the position of a second one of the print heads.

17 Claims, 3 Drawing Sheets

PRINT PREVIEW FOR PRINTERS WITH MULTIPLE PRINT HEADS

BACKGROUND

This invention relates generally to the field of printing systems, and more particularly to printers in which the print heads do not move during printing operations.

For printing applications such as printing out envelopes or letters for large mailings, it may be desirable to print at faster rates than is possible with printers that employ moving print heads. For these applications, high speed printing systems have been developed that employ two or more print heads that are fixed during printing operations. The positions of the print heads may be adjusted during set-up for a print job.

Conventional print preview software has not provided satisfactory guidance to users in regard to fixed-head printers. A fixed head printer can only print on the portions of the substrate (e.g., envelope or letter stock) which correspond to the positions of the print heads set for the printing job. But conventional print preview displays fail to take into account the "dead zones" on the substrate resulting from the positioning of the fixed heads. As a result, conventional print preview displays may present a misleading image of the print layout that will actually be produced. For example, a conventional print preview display (or a display provided during composition of a print layout) may show text in a portion of the printing stock profile that cannot be printed on by the print heads as currently positioned. In other words, with conventional print preview displays for fixed-head printers, what you see is not necessarily what you get. Consequently, printing errors may occur in which text appears on the printed items at different locations from those the user desired. This may lead to decreased efficiency, spoiled printing stock, and lost time and effort.

SUMMARY

Accordingly, an improved printing system and method are provided. The improved system includes a first print head for printing at a first position along a first print axis, a second print head for printing at a second position along a second print axis, a transport mechanism for transporting substrates adjacent the first and second print heads in a direction transverse to the print axes, a control device coupled to the first and second print heads, and a display device coupled to the control device. The control device is operative to control the display device such that the display device displays a representation of a substrate. The control device also controls the display device to display a first printing field at a first location in the representation of the substrate. The first location corresponds to the first position (i.e., the position of the first print head). The control device also controls the display device to display a second printing field at a second location in the representation of the substrate. The second location corresponds to the second position (i.e., the position of the second print head).

The printing system may also include a head positioning mechanism that is responsive to the control device and selectively re-positions the first and second print heads along the print axes.

The control device may control the display device to display at least one interactive display element. The user of the system may be permitted to interact with the at least one interactive display element to control the head positioning mechanism to adjust the positions of the first and second print heads.

The display device may display in the first printing field an indication of at least one type of information to be printed by the first print head and may display in the second printing field an indication of at least one type of information to be printed by the second print head.

The representation of the substrate may be in a shape that corresponds to a profile of a mailing envelope.

In another aspect, there is provided a method of operating a printing system. The printing system includes a first print head located at a first position along a first print axis and a second print head located at a second position along a second print axis. The method includes displaying a representation of a substrate, displaying a first printing field at a first location in the representation, and displaying a second printing field at a second location in the representation. The first location corresponds to the first position (the position of the first print head) and the second location corresponds to the second position (the position of the second print head).

The method may further include displaying an interactive display element, allowing a user of the printing system to interact with the interactive display element to provide user input, and responding to the user input by repositioning at least one of the print heads. The method may also include changing at least one of the first and second locations (the locations of the printing fields) to indicate the repositioning of the print heads.

In another aspect a printing system includes a print head that remains in a fixed position during printing operations. The printing system further includes a mechanism for determining the fixed position of the print head. The printing system further includes a display mechanism which is responsive to the mechanism for determining. The display mechanism is for providing a print preview display. The print preview display is indicative of the fixed position of the print head relative to a profile of an item of printing stock to be used in a printing job.

As used herein and in the appended claims, "determining" a position of a print head may include one or both of moving the print head to such position or detecting such position.

The display mechanism may be part of a user interface, and the printing system may further include a mechanism that is responsive to user input provided via the user interface, such mechanism being for re-positioning the print head prior to the printing job.

The printing system may further include a transport mechanism for transporting items of printing stock adjacent the print head.

The print head may be one of a plurality of print heads for printing respective items of information on each one of the items of printing stock. The print preview display may be indicative of a respective fixed position of each of the print heads relative to the profile of the item of printing stock.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes a printing system and a method of operating the printing system. The printing system includes two or more print heads that are fixed during printing operations, but adjustable in position in between printing operations. The printing system provides to an operator of the printing system a print preview screen display that shows where on the substrate (e.g., on the envelope or letter stock) each print head is positioned to print. The print preview screen display may also identify the types of information each print head will print. Thus effectively the print preview screen display provides a "what you see is what you get" display that allows the operator to make any adjustments in print head position that may be needed to obtain exactly the print-out configuration that the operator desires. As a result, the operator may fully control the printing operation and may avoid costly errors in printing.

Figure 1:
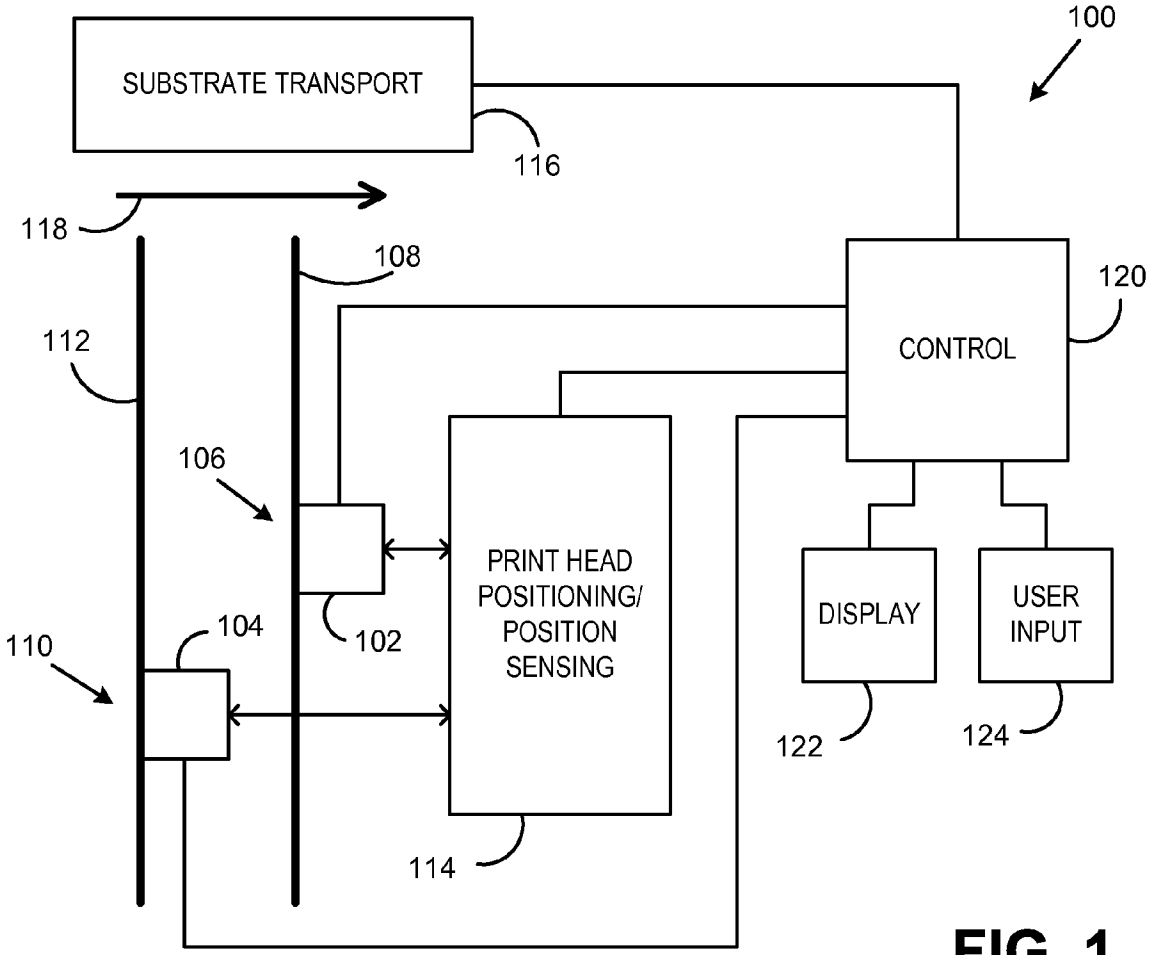
FIG. 1 is block diagram of a printing system provided in accordance with the present invention.

Referring now to the drawings, and particularly to FIG. 1, the reference numeral 100 indicates generally a printing system provided in accordance with the present invention. The printing system 100 includes print heads 102, 104 which are indicated schematically as functional blocks. The print heads 102, 104 are of the so-called "fixed" type in that the print heads do not move during printing operations. Print heads of this type are suitable for use in high-volume printing operations, and the printing system 100 may be suitable for expeditiously handling jobs that require printing of thousands of pieces, such as envelopes, bills and/or letters for a large mailing.

Prior to the start of a print job, the print head 102 may be positioned at a first position 106 along a first print axis 108, and the print head 104 may be positioned at a second position 110 along a second print axis 112. The print axes 108, 112 may be parallel to each other; in some embodiments the print axes may coincide.

The printing system 100 may also include a mechanism (represented by block 114) which is operative to re-position the print heads along their respective print axes. In addition, or alternatively, the mechanism 114 may be operative to detect the positions of the print heads along the print axes. The print head positioning/position-detection mechanism 114 may include a suitable combination of motors, drive elements such as belts or the like, and/or sensors or encoders, none of which are separately shown.

In addition, the printing system 100 may include a substrate transport mechanism 116. The substrate transport mechanism 116 is operative to transport a sequence of substrates (not shown; may be, e.g., items of letter stock or envelope stock) in a transport path adjacent to the print heads 102, 104. The substrate transport mechanism 116 transports the substrates in a transport direction (indicated by arrow 118) which is transverse to the print axes 108, 112. The substrate transport mechanism may provide all of the motion of the substrates relative to the print heads, since as noted before the print heads do not move during printing operations.

The printing system may further include a control device 120 which is coupled to the print heads 102, 104 and to the print head positioning/position-detection mechanism 114 as well as to the substrate transport mechanism 116. In some embodiments, the control device 120 may include a conventional microprocessor (not separately shown) and associated memory devices (not separately shown) to serve for working memory and program storage. The control device 120 may control operations of the print head positioning/position detecting mechanism 114 to set the positions of the print heads 102, 104 and/or may receive output from the print head positioning/position detecting mechanism which indicates the positions of the print heads 102, 104. In addition, the control device 120 may control operation of the substrate transport mechanism 116 and may control the print heads 102, 104 to cause the print heads to print desired information on the substrates transported by the substrate transport mechanism 116.

Still further, the printing system 100 may include a display device 122 which is coupled to and controlled by the control device 120. The display device may be, for example, a conventional CRT or flat panel display. The printing system may further include user input devices 124 such as a keyboard and a mouse, which are not separately shown. Together with software which programs the control device 120, the display device 122 and the user input devices 124 may implement a graphical user interface by which the user may control the printing system 100.

Figure 2:
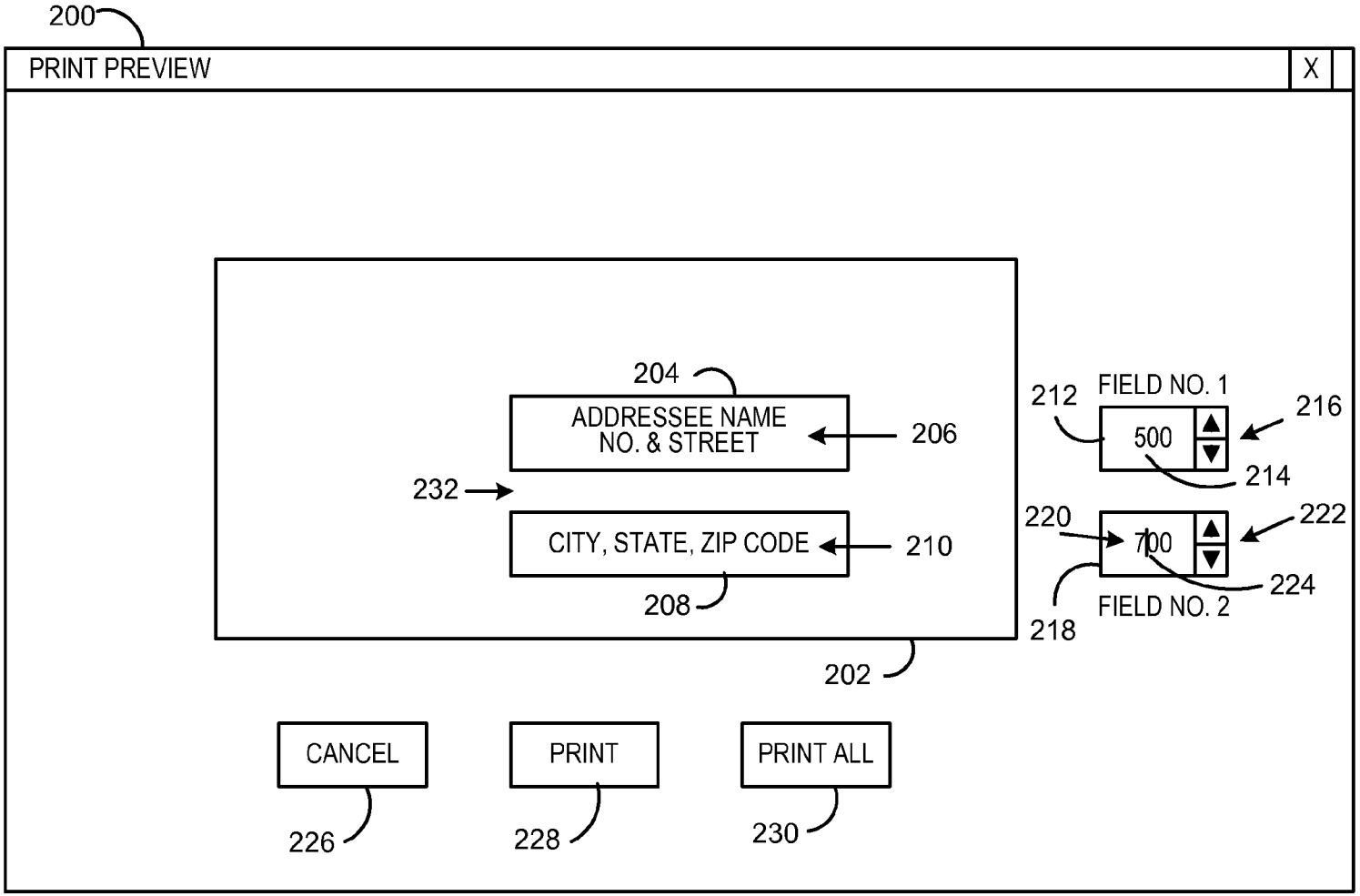
FIG. 2 is an example of a screen display image that may be provided by the printing system of FIG. 1.

FIG. 2 is an example of a "print preview" screen display image that the control device 120 may cause the display device 122 to display in accordance with aspects of the present invention. The display of FIG. 2 includes a rectangular outline 202 which is a representation of the profile of a substrate (in this example, an envelope) of the type that is to be printed in the printing job that is previewed by the screen display. The screen display also includes a first printing field 204 which is at a location in the representation 202 that indicates where information to be printed by the print head 102 will appear on the envelopes if the print job goes forward as presently configured. Thus the printing field 204 corresponds to the position of the print head 102 along the print axis 108. Within the first printing field 204 there is displayed alphanumeric information 206 to indicate the type(s) of information to be printed by the print head 102. (In this example, the information to be printed by the print head 102 is the addressee's name on a first line and the number and street on a second line.)

The screen display also includes a second printing field 208 which is at a location in the representation 202 that indicates where information to be printed by the print head 104 will appear on the envelopes if the print job goes forward as presently configured. The second printing field 208 corresponds to the position of the print head 104 along the print axis 112. Within the second printing field 208 there is displayed alphanumeric information 210 to indicate the type(s) of information to be printed by the print head 104. (In this example, the information to be printed by the print head 104 is the city, state and zip code in a single line.)

The screen display further includes a first interactive display element 212. The first interactive display element 212 is positioned to the side of the representation 202 and in alignment with the first printing field 204. The first interactive display element 212 includes a numeric field 214 and arrow buttons 216. The numeric field 214 contains numeric information that indicates a Y-direction position of the first printing field 204 in the representation 202. Correspondingly, the numeric information in numeric field 214 also indicates the position of the print head 102 along the print axis 108 and where along the Y-direction the information to be printed by the print head 102 will appear on the envelopes to be printed in the print job currently being previewed.

The screen display further includes a second interactive display element 218. The second interactive display element 218 is positioned below the first interactive display element 212 and in alignment with the second printing field 208. The second interactive display element 218 includes a numeric field 220 and arrow buttons 222. The numeric field 220 contains numeric information that indicates a Y-direction position of the second printing field 208 in the representation 202. Correspondingly, the numeric information in numeric field 220 also indicates the position of the print head 104 along the print axis 112 and where along the Y-direction the information to be printed by the print head 104 will appear on the envelopes to be printed in the print job currently being previewed.

A cursor 224 is shown in numeric field 220 of second interactive display element 218. The user may operate the user input devices 124 (FIG. 1), e.g., the mouse, to position the cursor 224 in either the numeric field 214 of the first interactive display element 212 or in the numeric field 220 of the second interactive display element 218. The user may then use the keyboard to directly change the numeric information in the numeric field 214 or the numeric field 220, as the case may be. Alternatively, the user may manipulate the arrow buttons 216 or 222 to increment or decrement the numeric information in the respective numeric fields. By either or both techniques, the user is allowed to interact with the interactive display elements to change the indicated numeric information. The control device 120 responds to this user input by controlling the print head positioning/position sensing mechanism 114 to re-position the print head 102 or 104, as the case may be, to reflect the updated position numeric data indicated by the user.

In some embodiments, the user may also provide input to re-position one or both of the print heads by "dragging" one or both of the printing fields 204, 208 with a pointer/cursor (not shown) controlled by a mouse operated by the user.

The display of FIG. 2 further has a cancel button 226, a print button 228 and a print_all button 230. Actuation of the cancel button 226 causes cancellation of the print job being previewed. Actuation of the print button 228 causes the first piece of the print job to be printed. Actuation of the print_all button 230 causes the entire job to be printed.

Figure 3:
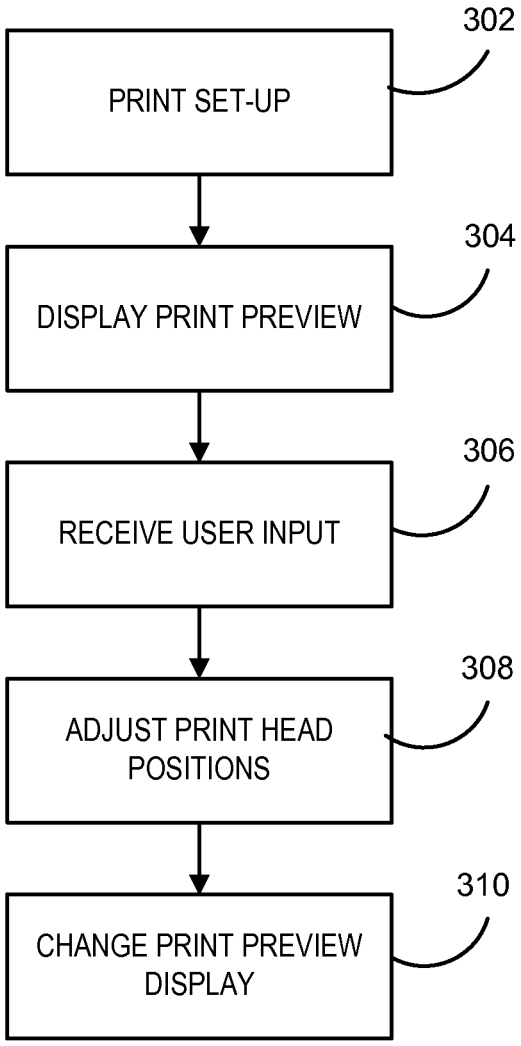
FIG. 3 is a flow chart that illustrates a process that may be performed by the printing system of FIG. 1.

FIG. 3 is a flow chart that illustrates a process that may be performed by the printing system 100.

At 302 in FIG. 3, a print job is set up in response to appropriate input from the user. Then, at 304, the user may elect to have a print preview display, and the control device 120 then controls the display device 122 to display a display screen of the kind illustrated in FIG. 2. At 306, the user may provide input by interacting with one or both of the interactive display elements 212, 218, as described above, and the resulting user input is received by the control device 120. For example, the user may interact with one or both of the interactive display elements to eliminate the gap 232 between the printing fields 204, 208. As indicated at 308, the control device 120 then responds to the user input by controlling the print head positioning/position sensing mechanism 114 to adjust the position of one or both of the print heads 102, 104 in accordance with the user input. Also, as indicated at 310, the print preview display may be updated to reflect the user input and the re-positioning of the print heads in response to the user input. That is, the location in the representation 202 of one or both of the printing fields 204, 208 may be changed in the display screen to reflect the new position(s) of the print head 102 and/or 104.

When the print preview display is satisfactory to the user, the user may cause the printing job to proceed.

With these features, and particularly the print preview display illustrated herein, the system may allow a user to readily detect and correct any difference between the printing configuration desired by the user and the printing configuration that would result from the current positioning of the print heads. This may help the user to avoid errors in setting up print jobs and may provide significant savings in time and effort while avoiding spoilage of printing stock due to errors.

In the example system described above there are two print heads, but in other embodiments there may be only one fixed print head, or three or more fixed print heads. From previous discussion it will be appreciated that the print heads may be fixed during printing operations while being adjustable in position before a print job is commenced.

The embodiment described above provides for adjustment of print head position by operation of motors and/or other electromechanical devices in response to data input to a control device by a user. In addition or alternatively, the system may allow for direct manual repositioning of print heads by the user.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A printing system, comprising:

a first print head for printing at a first position, determined by a first print head position sensor, along a first print axis;

a second print head for printing at a second position, determined by a second print head position sensor, along a second print axis;

transport means for transporting substrates adjacent said first and second print heads in a direction transverse to said print axes;

a control device coupled to said first and second print heads; and a display device coupled to said control device;

said control device operative to control said display device such that said display device displays:

a representation of a substrate;

a first printing field at a first location in said representation, said first location corresponding to said first position; and a second printing field at a second location in said representation, said second location corresponding to said second position, wherein:

said display device displays in said first printing field an indication of at least one type of information to be printed by said first print head; and said display device displays in said second printing field an indication of at least one type of information to be printed by said second print head.

2. A printing system according to claim 1, further comprising:

head positioning means, responsive to said control device, for selectively re-positioning said first and second print heads along said print axes.

3. A printing system according to claim 2, wherein said control device is configured to control said display device to display at least one interactive display element, and to permit a user of said system to interact with said at least one interactive display element in order to permit control of said head positioning means to adjust said first and second positions.

4. A printing system according to claim 3, wherein said at least one interactive display element is configured to display numeric information related to the location of at least one of the first and second print heads along its axis.

5. A printing system according to claim 1, wherein said representation is in a shape that corresponds to a profile of a mailing envelope.

6. A printing system according to claim 1, wherein said first print axis coincides with said second print axis.

7. A printing system according to claim 1, further comprising:

at least one head positioning mechanism configured to selectively re-positioning said first and second print heads along said print axes during a print job set-up procedure.

8. The printing system according to claim 1, wherein, said first printing field at a first location in said representation, said first location determined by said at least one print head position sensor to represent said first position; and said second printing field at a second location in said representation, said second location determined by said at least one print head position sensor to represent said second position.

9. The printing system according to claim 8, wherein:

said display device displays in said first printing field an indication of at least one type of information to be printed by said first print head, said indication comprising information to be printed in said first printing field; and said display device displays in said second printing field an indication of at least one type of information to be printed by said second print head, said indication comprising information to be printed in said first printing field.

10. A method of operating a printing system, the printing system including a first print head located at a first position along a first print axis and a second print head located at a second position along a second print axis, the method comprising:

determining said first and said second position using at least one print head position sensor;

displaying a representation of a substrate;

displaying a first printing field at a first location in said representation, said first location corresponding to said first position;

displaying a second printing field at a second location in said representation, said second location corresponding to said second position;

displaying in said first printing field an indication of at least one type of information to be printed by said first print head; and displaying in said second printing field an indication of at least one type of information to be printed by said second print head, further comprising:

displaying an interactive display element;

allowing a user of the printing system to interact with the interactive display element to provide user input.

11. A method according to claim 10, further comprising:

responding to said user input by repositioning at least one of said print heads.

12. A method according to claim 11, further comprising:

changing at least one of said first and second locations to indicate said repositioning.

13. A method according to claim 10, wherein said representation is in a shape that corresponds to a profile of a mailing envelope.

14. A method according to claim 10, wherein said first print axis coincides with said second print axis.

15. A method of operating a printing system, the printing system including a first print head located at a first position along a first print axis and a second print head located at a second position along a second print axis, the method comprising:

determining said first and said second position using at least one print head position sensor;

displaying a representation of a substrate;

displaying a first printing field at a first location in said representation, said first location corresponding to said first position;

displaying a second printing field at a second location in said representation, said second location corresponding to said second position;

displaying in said first printing field an indication of at least one type of information to be printed by said first print head;

displaying in said second printing field an indication of at least one type of information to be printed by said second print head;

displaying an interactive display element;

allowing a user of the printing system to interact with the interactive display element to provide user input; and responding to said user input by repositioning at least one of said print heads, wherein, displaying an interactive display element comprises displaying numeric information related to the location of at least one of the first and second print heads along its axis.

16. The method according to claim 15, wherein, said first printing field at a first location in said representation, said first location determined by said at least one print head position sensor to represent said first position; and said second printing field at a second location in said representation, said second location determined by said at least one print head position sensor to represent said second position.

17. The method according to claim 16, wherein:

displaying in said first printing field an indication of at least one type of information to be printed by said first print head, said indication comprising information to be printed in said first printing field; and displaying in said second printing field an indication of at least one type of information to be printed by said second print head, said indication comprising information to be printed in said second printing field.

* * * * *